US005124756A

United States Patent [19]

Stelter

[11] Patent Number: 5,124,756

[45] Date of Patent: Jun. 23, 1992

[54] DUPLEX APPARATUS HAVING A ROLLER FUSER

[75] Inventor: Eric C. Stelter, Rochester, N.Y.

[73] Assignee: Eastman Kodak Company, Rochester, N.Y.

[21] Appl. No.: 602,587

[22] Filed: Oct. 24, 1990

[51] Int. Cl.[5] ..... G03G 15/20

[52] U.S. Cl. ..... 355/290; 219/216; 355/319

[58] Field of Search ..... 355/24, 319, 208, 282, 355/285, 289, 290; 219/216, 469; 432/60

[56] References Cited

U.S. PATENT DOCUMENTS

| | | | |
|---|---|---|---|
| T967,010 | 2/1978 | Stryjewski | 432/60 |
| 3,268,351 | 8/1966 | Van Dorn | 355/284 X |
| 3,945,726 | 3/1976 | Ito et al. | 355/284 |
| 4,018,555 | 4/1977 | Thettu | 219/216 X |
| 4,019,024 | 4/1977 | Namiki | 219/216 X |
| 4,056,706 | 11/1977 | Strella | 219/216 |
| 4,191,465 | 3/1980 | Boase et al. | 355/319 |
| 4,231,653 | 11/1980 | Nagahara et al. | 355/283 |
| 4,429,990 | 2/1984 | Tamary | 355/284 |
| 4,526,459 | 7/1985 | Bresnick | 355/285 |
| 4,549,803 | 10/1985 | Ohno et al. | 355/284 |
| 4,595,274 | 6/1986 | Sakurai | 355/290 |
| 4,618,240 | 10/1986 | Sakurai et al. | 219/216 |
| 4,737,818 | 4/1988 | Tanaka et al. | 355/290 |
| 4,905,051 | 2/1990 | Satoh et al. | 355/290 |
| 4,910,559 | 3/1990 | Kuge et al. | 355/285 |
| 5,051,780 | 9/1991 | Stelter et al. | 355/208 |

*Primary Examiner*—A. T. Grimley
*Assistant Examiner*—Robert Beatty
*Attorney, Agent, or Firm*—Leonard W. Treash, Jr.

[57] ABSTRACT

A copier or printer uses the principle of single pass duplexing which produces simplex output at full machine speed and duplex output with a gap of at least one sheet between sheets. It has a duplex fuser that fuses both duplex images simultaneously. The duplex fuser has a first relatively hard roller which contacts the side of receiving sheets carrying simplex images and a soft heated roller which contacts the opposite sides of sheets. The soft roller is heated, in part, by a lamp in its center, and, in part, by heat from the first roller which is passed to the soft roller between duplex sheets. The soft roller therefore runs at a higher temperature for duplex than it does for simplex. The hard roller preferably has a thin elastomeric layer on a metal core and therefore transfers heat to its surface more efficiently and faster than the soft roller.

5 Claims, 2 Drawing Sheets

DUPLEX APPARATUS HAVING A ROLLER FUSER

TECHNICAL FIELD

This invention relates to electrostatographic apparatus of the type which can generate receiving sheets having toner images on one side (simplex) or toner images on both sides (duplex). More specifically, this invention relates to such apparatus having a roller fuser for fixing duplex images in a single pass.

BACKGROUND ART

U.S. Pat. No. 4,429,990, issued Feb. 7, 1984 to E. J. Tamary, shows an electrophotographic copier which forms a series of toner images. The copier has two transfer stations. In a simplex mode, one transfer station is used to transfer toner images to a single side of receiving sheets which are then fed to a fuser for fixing. In a duplex mode, receiving sheets are fed to a first transfer station for receiving toner images on one side, immediately turned over, fed to a second transfer station to receive a toner image on the other side and then fed to the fuser where both images are fused simultaneously.

The machine shown in the Tamary patent has been successful commercially. It has the very important advantage of providing duplex output without passing the copy sheet through the fuser twice. It is termed a "single pass" duplexing apparatus. It is contrasted with "double pass" duplexing systems in which a series of sheets receive one image, are fused and placed in an intermediate tray. They are fed back to the image member to receive the second image and pass through the fuser again. One image receives twice the fusing of the other and the sheet is heated twice.

Although the advantages of "single pass" duplexing are many, the task of fusing duplex images in one mode and simplex images in another mode while controlling the surface temperatures of the fusing members is challenging. The commercial duplex fuser utilizing the Tamary technology has a pair of fusing rollers which are each heated from within. The fusing roller which contacts the side of a receiving sheet carrying a simplex image (called the "simplex roller") has a thick elastomeric covering on a metal core.

The other fusing roller (the "duplex roller") has a thin elastomeric covering also on a metal core. Both fusing rollers have temperature control devices which sense the surface temperature of the metal core outside the image area to control the power applied to internal heating lamps within the rollers. Because of the thickness of the elastomer on the roller contacting the simplex side of the receiving sheets, a relatively high set point must be used for the metal core of that roller. This is because the temperature of the exterior surface of the elastomer for any given roller with a constant heat source decreases as a function of the thickness of the elastomer.

Although this apparatus produces excellent images, the power consumption of the fuser is substantial, even working with relatively low fusing temperature toners. Further, while the core temperature of the simplex roller is not too high using toners fusable at 340° F. for which it is designed, to use higher fusing temperature toners (for example, 380° F.) the core temperature leaves little upper latitude with respect to a high shut off point for the fuser and the char point of paper. Even at lower fusing temperatures, throughput is limited by the limit on the core temperature. Additionally, the thick outer layer causes a droop in temperature at the beginning of a run requiring a toner that fuses over a wide range of temperatures.

A number of references show simplex fusers which include heating lamps in both rollers. The heating lamp in the roller that does not contact the image is generally used to prevent that roller from lowering the temperature of the roller which does contact the image when the rollers are in contact between images. See, for example, U.S. Pat. No. 4,231,653, Nagahara et al, issued Nov. 4, 1980; U.S. Pat. No. 4,549,803, Ohno et al, Oct. 29, 1985; U.S. Pat. No. 4,595,274, Sakurai, Jun. 17, 1986; U.S. Pat. No. 4,618,240, Sakurai et al, Oct. 21, 1986; U.S. Pat. No. 4,019,024 Namiki, Apr. 19, 1977; U.S. Pat. No. 3,945,726, Ito et al, Mar. 23, 1976 and U.S. Pat. No. 3,268,351, VanDorn, Aug. 23, 1966.

DISCLOSURE OF THE INVENTION

The object of the invention is to improve the temperature control and/or power consumption of a duplex fuser in an apparatus for forming either simplex or duplex copies. Improved power consumption can be taken advantage of by 1) reducing power consumption, 2) increasing throughput, and/or 3) increasing the fusing temperature.

This and other objects are accomplished by a duplex fuser for apparatus generally of the single pass duplex type described in the Tamary patent, which fuser has first and second independently heated fusing rollers. The first fusing roller (the simplex roller) contacts the side of the receiving sheets carrying simplex images while a second fusing roller (duplex roller) contacts the opposite side of the sheets, thus, contacting images only in duplex. The first fusing roller is a relatively hard roller while the second fusing roller has a thick elastomeric material on top of a metal core. Both rollers have outside surfaces resistant to toner offset.

According to a preferred embodiment, the first roller has a thin elastomeric layer on a metal core which because of its thinness does not substantially inhibit the passing of heat from the core to a simplex image being fused. In simplex operation, the first roller, because of the thinness of this layer, is efficient in heat transfer, fixing simplex images at full machine speed with relatively small spaces between receiving sheets. Compared to a simplex roller having a thick elastomeric coating, its core runs cooler and the temperature droop at the beginning of a run is reduced.

In duplex, sheets are received only half as fast as they are received in simplex. More significantly, and unlike "double pass" systems, all duplex sheets are separated from each other by a space at least equal to another sheet. The second roller has a thick elastomeric outer layer and is also heated from within. Because of the space between sheets in duplex, the second roller is also heated by contact with the first roller during such spaces. Because this particular apparatus provides its duplex output with regular one sheet spaces between sheets, the second roller can reliably obtain enough heat from the first roller in duplex to raise its temperature adequately to fuse toner images on the opposite side of the sheet. Thus, with this arrangement, a large amount of the heat for fusing both images is supplied by the first fusing roller, which fusing roller has at most a thin elastomeric covering and is therefore efficient in transferring heat.

BRIEF DESCRIPTION OF THE DRAWINGS

In the detailed description of the preferred embodiment of the invention presented below, reference is made to the accompanying drawings, in which.

BEST MODE OF CARRYING OUT THE INVENTION

Figure 1:
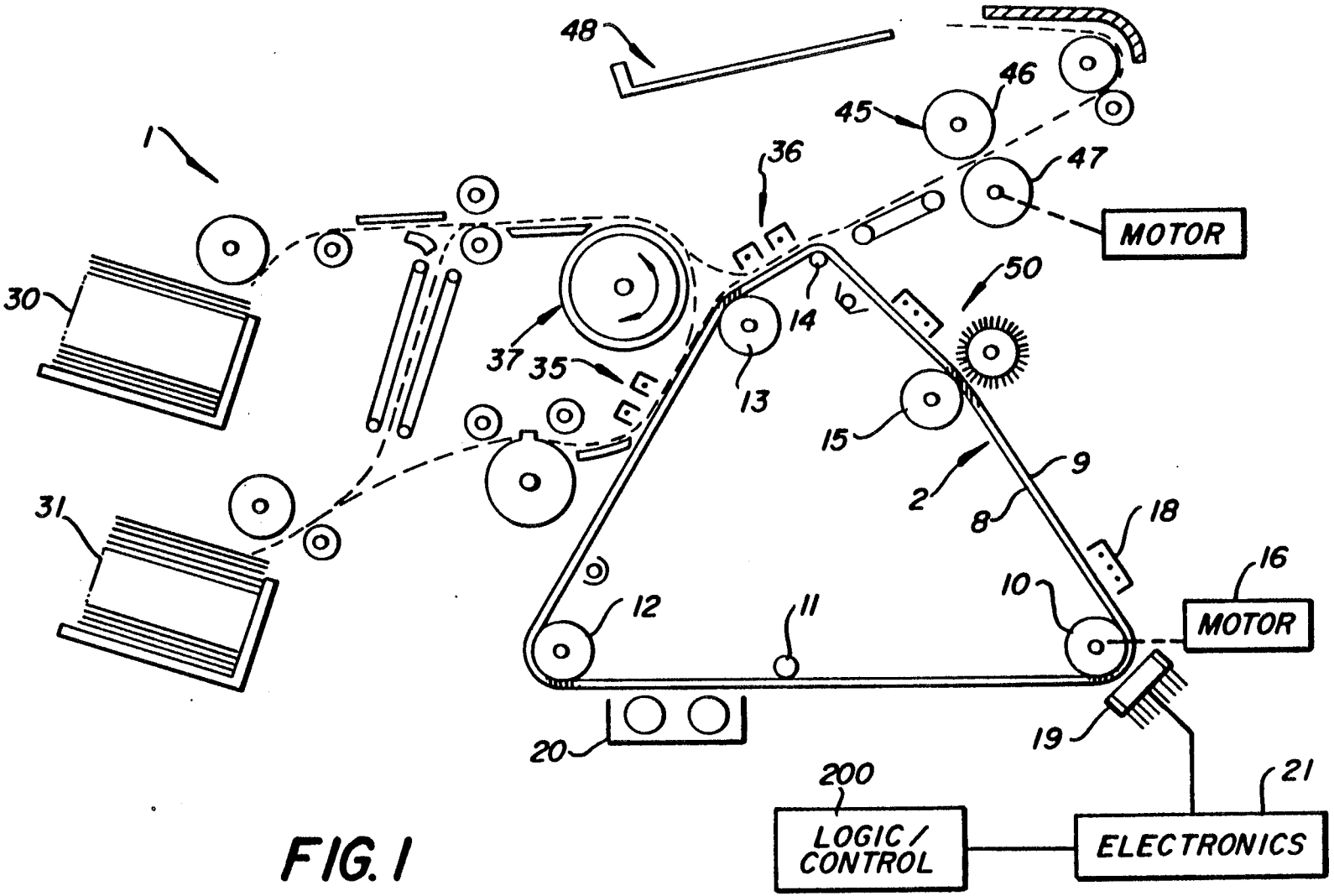
FIG. 1 is a side schematic of an apparatus illustrating the invention.

FIG. 1 shows an electrophotographic printer 1 which uses the principle of single pass duplexing. According to FIG. 1, an image member 2 is an endless belt having one or more electrophotosensitive layers 9 on a conductive backing 8. Image member 2 is entrained about a series of rollers 10, 11, 12, 13, 14 and 15 and is driven past a series of stations by a motor 16 connected to roller 10. Image member 2 is uniformly charged at a main charging station 18, imagewise exposed at an electronic exposure station 19 to create a series of electrostatic images in response to an electronic signal coming from an electronic source 21 which electronic source can be a computer, a scanner, a memory, or the like. The series of electrostatic images on image member 2 are toned at a toning station 20 to create a series of toner images defined by the electrostatic images.

Printer 1 has a pair of transfer stations 35 and 36 for transferring toner images to receiving sheets fed from either of receiving sheet supplies 30 or 31. If simplex output is desired, receiving sheets are fed from either of receiving sheet supplies 30 or 31 to second transfer station 36 where the receiving sheets arrive in timed relation with the toner images and are transferred by conventional corona transfer. The receiving sheets separate from image member 2 as image member 2 passes around small roller 14 and are transported to duplex fuser 45 which include rollers 46 and 47. The simplex images are fused by application of heat and pressure by rollers 46 and 47 and transported through an inversion to arrive face up in an output hopper 48. Image member 2 is cleaned at cleaning station 50 for reuse.

If duplex output is desired, receiving sheets are fed from receiving sheet supply 31 to first transfer station 35 where a first side of the receiving sheet receives a first toner image. The receiving sheet is separated from image member 2 and turned over by a turnover roller 37 and immediately fed back to second transfer station 36 to receive a second toner image on its opposite side. The receiving sheet again separates from image member 2 as image member 2 passes around small roller 14 and is transported to fuser 45 where both images are simultaneously fused to opposite sides of the sheet and then deposited with its first side up in output tray 48.

Figure 2:
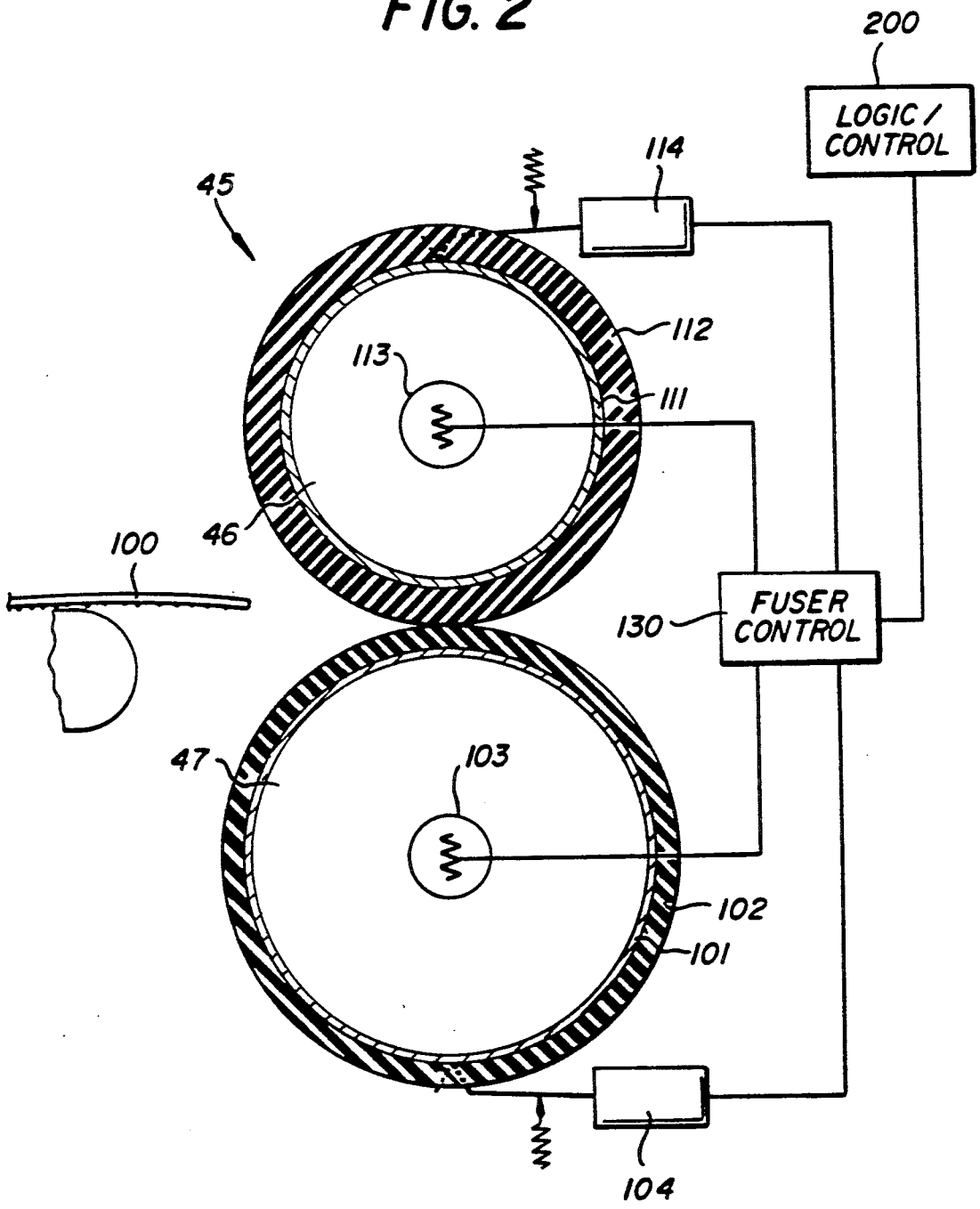
FIG. 2 is a side schematic section of a fuser portion of the apparatus shown in FIG. 1.

Fuser 45 is shown in more detail FIG. 2. According to FIG. 2, first fusing roller 47 contacts the image side of a receiving sheet 100 carrying a simplex image and is commonly called the "simplex roller." Simplex roller 47 has a metal core 101 and is preferably covered by a thin elastomeric covering 102 of a material which defines the outside surface of simplex roller 47 which surface is resistant to offset of toner. For example, the elastomeric material can be a conventional silicone rubber presently used in fusers.

The simplex fusing roller 47 is heated by a short filament quartz lamp 103 which preferably does not stretch to the ends of the roller 47. Lamp 103 is preferably relatively high power. For example, for fusing legal-sized sheets having a cross-track dimension of 14 inches and standard sized sheets having a cross-track dimension of 11 inches, lamp 103 can be powered by 1850 watts across a 14¼ inch filament.

Second fusing roller 46, commonly called the "duplex roller," has a metal core 111 similar to core 101 in first roller 47. It is covered with a relatively thick elastomeric coating and is heated by a somewhat less powerful but longer lamp 113. For example, lamp 113 can be powered by 1250 watts across a 16 inch filament.

Elastomeric layer 102 is sufficiently thin, for example, 20 mils, to make simplex roller 47 relatively hard compared to duplex roller 46 whose elastomeric layer 112 is thicker, for example, 100 mils. Rollers 46 and 47 thus form a nip which is curved into the duplex roller, approximately conforming to the cylindrical (uncompressed) outer periphery of first roller 47. The temperature of core 101 is monitored by a temperature sensor 104 and the temperature of core 111 is monitored by a temperature sensor 114 whose outputs are fed to a fusing control 130 which in turn controls the power supplied to lamps 103 and 113.

During simplex fusing, printer 1 produces simplex output at full machine speed. That is, receiving sheets have images transferred to them and enter the fuser at a rate approximating that of the movement of image member 2 with a small, for example, less than 1 inch, space between sheets. Core 101 for simplex roller 47 has a simplex set point at a temperature sensed by sensor 104 that is high enough to fuse images at this rate taking into consideration the thickness of thin layer 102. Duplex roller 46 is heated by heat lamp 113 to supply some heat to the process, which reduces the amount of heat lost by the simplex roller 47 between the receiving sheets. However, the duplex roller 46 does not have a set point that would by itself be consistently high enough to fuse images on the back side of receiving sheet 100.

In single pass duplex operation, sheets are received from image member 2 at a consistent, every-other-frame, rate. That is, consecutive receiving sheets are separated by a gap equal, at least, to the in-track dimension of a receiving sheet. During this time, heat from the simplex roller 47 transfers to the duplex roller 46, thereby raising the exterior temperature of duplex roller 46 above that attributable to the heat from core 111. The heat from simplex roller 47 raises the temperature of the surface of duplex roller 46 adequately to allow roller 46 (with the heat received from its heat source 113) to fuse images carried on the back of a duplex receiving sheet while the simplex roller fuses images on the front side of the receiving sheet.

This system has the advantage of supplying much of the heat for both simplex and duplex fusing from the simplex roller 47. Simplex roller 47 has the thin elastomeric cover 102 and therefore readily transfers heat to the nip.

This approach permits running at higher throughput and/or higher roller surface temperatures, without excessive roller core temperatures. At the same time, heat is more effectively utilized and therefore the fuser heats up the environment less than prior duplex fusers.

Although both rollers 47 and 46 have elastomeric layers in the preferred embodiment shown in FIG. 2, roller 47 could have only a thin layer of offset preventing material such as polytetrafluoroethylene directly on core 101. To assure comparable appearance of both images in duplex, roller 46 should then have a coating of the same offset preventing material on elastomeric layer 112.

In the prior art duplex fuser presently in use, which has a 100 mil and a 20 mil elastomer coatings on simplex and duplex rollers, respectively, core set points on the simplex and duplex rollers when in standby are approximately 345° F. and 330° F., respectively. For 11 inch simplex receivers these set points are increased to simplex run set points of approximately 415° F. and 340° F., respectively. The surface temperature of the simplex roller can droop to as low as 305° F. at startup using these parameters, with a power consumption as high as 2500 watts. This device is designed for use with toners having a desired fusing temperature of 340° F.

In a fuser constructed as shown in FIG. 2 standby set points of 340° F. and 366° F. are used for simplex and duplex rollers, respectively. These are increased to 395° F. and 415° F., respectively, during a simplex run. This provides a steady state surface temperature on the simplex roller of approximately 380° F. with little droop and maximum overshoot to about 395° F. Using these set points, the duplex roller surface temperature is maintained between 340° F. and 350° F. during simplex operation.

In duplex, the duplex roller set point is allowed to remain at 415° F. while the simplex roller set point is reduced to 375° F. This maintains the surface temperature of each roller at between 380° F. and 390° F. for duplex fusing, again with negligible droop.

The temperatures in each mode are maintained with an average power consumption less than 2500 watts. This structure is designed for use with a toner having a preferred fusing temperature of about 380° F.

Thus, the FIG. 2 fuser provides more even fusing with less droop and danger of overheating than the prior art despite increasing the fusing temperature from 340° F. to 380° F. This structure therefore allows use of a higher fusing temperature toner in the FIG. 1 apparatus.

The surface temperatures are measured in the middle of the image while the core set points are dependent upon sensors in the margins outside of the images which tend to be cooler than the middle of the core. This explains the simplex roller core set point in duplex being lower than either roller surface temperature.

The specific examples of set points set out above are for 11 inch receiver sheets. Higher set point for 13 or 14 inch receiving sheets are required to provide essentially the same fusing temperature at each surface. This adjustment between letter and legal or other size sheets is a feature presently known in the art.

Note that apparatus 1 is shown as a printer using an LED printhead 19 connected to a source 21. The fuser according to FIG. 2 could also be used with an optical copier similar to that shown in U.S. Pat. No. 4,429,990, referred to above.

If the source 21 is a computer which is generating data at a rate that, in some instances, due to its complexity does not keep up with the speed of the printer 1, a logic and control 200 of printer 1 may add one or more skip frames to its processing cycle. That is, until the data stream being fed by source 21 into printhead 19 is complete, one or more frames may not be imaged. If this happens continually in either simplex or duplex operation, the fuser 45 may run without sheets passing through it, but with a higher "run" set point. This will cause overheating of the fuser with known problems, such as "hot offset", charring of paper and overheating shutdown by safety sensors (not shown).

To solve this problem, logic and control 200 for the apparatus can be programmed to adjust the set point(s) in fuser control 130 in a downward direction in response to the occurrence of skip frames.

This approach involves decreasing the core temperature set points from simplex values (used for maximum heat loss conditions) to standby values (used for minimum heat loss conditions) as a function of the number of skip frames per fused receiver. A fuser roller consisting of a elastomeric coating on a metal core can be modeled as a hollow cylinder, which is the coating, with the inner surface held at a uniform temperature equal to the temperature of the core. According to well known thermal equations, the flow of heat per unit length of the cylinder is equal to:

$$2\pi K(v_1 - v_2)/\ln(b/a)$$

where K is the thermal conductivity of the elastomer, $v_1$ and $v_2$ are the temperatures of the inner and outer surfaces of the cylinder and a and b are the radii of the inner and outer surfaces of the cylinder. From this it can be seen, that, if the outer surface at b is to be kept at $v_2$ and the heat flow out of the system is reduced (for example, due to skip frames), then the difference $(v_1 - v_2)$ must be reduced proportionally to reduce the flow of heat to the outer surface to keep $v_2$ from increasing. It is also apparent that the heat flow from a roller with a thick elastomeric coating is less than that of a thinly coated roller. Therefore, one method of controlling roller surface temperature is to first decrease the thinly coated simplex roller set point incrementally toward standby. Once the standby position is reached for the simplex roller, the duplex roller is reduced incrementally to standby. For example, for one skip frame the simplex roller is set to a value necessary to maintain constant net heat flow and roller surface temperatures at the aim fusing temperature. For two skip frames it is decreased slightly more, and so on, until the standby values for both rollers is reached.

However, in actual practice, this much sophistication does not appear to be necessary. The printer shown in FIG. 1 may have five or six image frames. Logic and control 200 receives three inputs relevant to fuser control, the appearance of a frame indicator at a sensing point relevant to exposure, an indication as to whether exposure is to be made for that frame, and an indication as to whether printing will be in duplex or not (simplex). In response to the frame indication signal, if the frame is to be exposed and printing is in simplex, the fuser is set at it simplex run set points. In response to a frame indication signal and an exposure indication signal with printing set at duplex, the temperature set points are positioned for duplex. If a frame indication signal is received and no exposure signal is received, the logic and control immediately sets the fuser set points down "one skip frame increment", unless both rollers' set points are already at standby, in which case no further adjustment is made.

Note that the fuser is immediately adjusted even though the frame to be skipped is four or five frames away from the fuser (the distance between the exposure station and the fuser). Four frames in a high speed printer may be equal to two or three seconds of time. Actual heat adjustment in this time is not fast enough to make a serious difference. However, if a series of skip frames occurs, definite overheating can result when sheets stop arriving at the fuser which this algorithm will adjust for.

A specific example of an approach to incremental setting of the fuser shown in FIG. 2 in response to skip frames is to adjust the simplex roller set point to its duplex value on occurrence of the first skip frame, then adjust the simplex roller to the standby value at the second skip frame. Then the duplex roller is adjusted to the standby value for the third and subsequent frames. A less precise approach would be to adjust the simplex roller to the standby at the first skip frame and the duplex roller to standby at the second skip frame. Both of these approaches substantially eliminate hot offset in a condition of a substantial and upredictable skip frames. When the raster image processor catches up, an image is exposed, and the fuser returns to its run set points.

Note that this algorithm for handling skip frames is not limited to single color printers. In printers that run often with a single color but occasionally combine images from consecutive frames onto a single side of a single sheet will also generate a condition similar to skip frames. That is, the flow of paper through the fuser will stop for a while. This invention can be used for such conditions. Note that the absence of paper in the fuser that causes the increase in temperature in a color copier or printer is due to superposing multiple frames on a single side of a sheet, rather than skipping an exposure frame. Thus, it may be preferable to key off the feeding of sheets rather than exposure as indicative of "skip frames", since exposure of images would not be a good indication of the paper passage through the fuser in this instance.

The invention has been described in detail with particular reference to a preferred embodiment thereof, but it will be understood that variations and modifications can be effected within the spirit and scope of the invention as described hereinabove and as defined in the appended claims.

I claim:

1. A reproductive apparatus which includes:

means for forming a series of loose toner images on an image member, means for transferring each of said toner images to a receiving sheet, and heated pressure roller fusing means for fixing each of said images to its receiving sheet, which apparatus includes 1) a simplex mode of operation in which receiving sheets are presented to said fusing means with an unfixed toner image on only one side at full machine speed, and 2) a duplex mode of operation in which receiving sheets are presented to said fusing means with an unfixed toner image on both sides and with at least a one sheet gap in presentation between sheets, said fusing means including a first roller for contacting the side of said receiving sheets carrying simplex images, a second roller for contacting a side of said receiving sheet opposite the side carrying simplex images, and heating means for heating said first and second rollers, characterized in that said second roller includes a metal core and a thick elastomeric layer on said core and said first roller includes a metal core and is hard compared to said second roller, said rollers forming a nip curved into said second roller and said heating means includes first and second heating means positioned inside the cores of said first and second rollers, respectively, first and second temperature sensing means for sensing the temperatures of the cores of the first and second rollers, respectively, and control means for controlling the first and second heating means in response to said sensing means, said control means providing a set point for controlling the second heating means to heat the core of the second roller to a temperature providing a temperature on the outside surface of said second roller below the temperature on the outside surface of the first roller such that the surface of said second roller requires transfer of heat from said first roller in order to maintain a fusing temperature when fusing duplex images.

2. Apparatus according to claim 1 wherein said first roller has a thin elastomeric layer on its metal core, said thin elastomeric layer having an outer surface resistant to toner offset.

3. Apparatus according to claim 2 wherein said thin elastomeric layer is approximately 20 mils thick.

4. Apparatus according to claim 1 wherein the thick elastomeric layer on the second roller is approximately 100 mils thick.

5. Apparatus according to claim 3 wherein the thick elastomeric layer on the second roller is approximately 100 mils thick.

* * * * *